US011702960B2

(12) United States Patent
Santais

(10) Patent No.: US 11,702,960 B2
(45) Date of Patent: Jul. 18, 2023

(54) TURBINE EXHAUST STRUCTURE OF PARTICULAR DESIGN

(71) Applicant: General Electric Technology GmbH, Baden (CH)

(72) Inventor: Frederic Santais, Boulogne-Billancourt (FR)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 78 days.

(21) Appl. No.: 16/372,485

(22) Filed: Apr. 2, 2019

(65) Prior Publication Data

US 2019/0226360 A1 Jul. 25, 2019

Related U.S. Application Data

(63) Continuation of application No. PCT/EP2017/074776, filed on Sep. 29, 2017.

(30) Foreign Application Priority Data

Oct. 3, 2016 (EP) ..... 16290192

(51) Int. Cl.
*F01D 25/24* (2006.01)
*F01D 25/30* (2006.01)
*F01D 9/06* (2006.01)

(52) U.S. Cl.
CPC ..... *F01D 25/24* (2013.01); *F01D 9/06* (2013.01); *F01D 25/243* (2013.01); *F01D 25/30* (2013.01); *F05B 2260/60* (2013.01); *F05D 2220/31* (2013.01); *F05D 2230/70* (2013.01); *F05D 2240/10* (2013.01); *F05D 2260/60* (2013.01)

(58) Field of Classification Search
CPC ..... F01D 25/24; F01D 25/30; F01K 7/16
USPC ..... 60/694
See application file for complete search history.

(56) References Cited

U.S. PATENT DOCUMENTS 1,269,998 A * 6/1918 Baumann ..... F01D 25/30 60/697
1,372,930 A * 3/1921 Baumann ..... F01K 11/02 60/693
4,326,832 A * 4/1982 Ikeda ..... F01D 25/30 415/103
4,622,819 A * 11/1986 Draper ..... B01D 45/16 55/392
4,803,841 A * 2/1989 Hargrove ..... F22B 37/26 60/657
4,986,732 A * 1/1991 Stock ..... F01D 13/02 138/155

(Continued)

FOREIGN PATENT DOCUMENTS

CN 205445696 U * 8/2016
JP 2007040228 A * 2/2007

OTHER PUBLICATIONS

European Search Repod issued in connection with corresponding European application No. 16290192.0 dated Mar. 3, 2017.

(Continued)

*Primary Examiner* — Justin D Seabe
(74) *Attorney, Agent, or Firm* — Grogan, Tucello & Vanderleeden, LLP

(57) ABSTRACT

A turbine exhaust structure for an intermediate-pressure exhaust end of a high-and-intermediate-pressure (HIP) module.

15 Claims, 5 Drawing Sheets

(56) References Cited

U.S. PATENT DOCUMENTS

| | | | | |
|---|---|---|---|---|
| 5,174,120 | A * | 12/1992 | Silvestri, Jr. | F01K 11/02 60/692 |
| 5,257,906 | A * | 11/1993 | Gray | F01D 25/30 415/226 |
| 7,632,066 | B2 * | 12/2009 | Arai | C22C 38/48 415/200 |
| 8,398,367 | B2 * | 3/2013 | Agara | F01D 11/005 60/39.182 |
| 9,033,656 | B2 * | 5/2015 | Mizumi | F01D 25/24 415/207 |
| 2005/0072157 | A1 | 4/2005 | Takahashi et al. | |
| 2007/0014671 | A1 | 1/2007 | Arai et al. | |
| 2013/0019600 | A1 * | 1/2013 | Neeli | F01D 25/30 60/670 |
| 2014/0047813 | A1 * | 2/2014 | Frailich | F01D 25/30 60/39.5 |

OTHER PUBLICATIONS

International Search Report issued in connection with corresponding PCT application No. PCT/EP2017/074776 dated Dec. 5, 2017.

* cited by examiner

PRIOR ART

PRIOR ART

TURBINE EXHAUST STRUCTURE OF PARTICULAR DESIGN

CROSS-REFERENCE TO RELATED APPLICATIONS

This application claims priority to, and is a continuation of, PCT/EP2017/074776 filed Sep. 29, 2017, which in turn claims priority to EP application 16290192.0, filed Oct. 3, 2016.

TECHNICAL FIELD

The present invention generally relates to power plant steam turbines and more particularly to a turbine exhaust structure, and even more particularly to an intermediate-pressure exhaust end, a part of a high-and-intermediate-pressure (HIP) module.

BACKGROUND

Typically, a power plant steam turbine is a device which converts thermal energy of pressurized steam to mechanical energy. The thermal energy is obtained by the production of steam by a boiler. The resulting steam flow is thus supplied to the steam turbine at the required pressure and temperature.

The turbine converts the steam flow into a torque which is used for driving a rotor of an electric generator to produce electrical energy. Particularly, the rotor of the electric generator is driven by means of a turbine shaft that interconnects the rotor with the steam turbine.

Generally, steam turbines comprise at least one high-pressure casing, at least one intermediate-pressure casing and at least one low-pressure casing.

For example, FIG. 1A shows a specific HIP casing 10 comprising an intermediate-pressure exhaust structure 11 connected to a combined high-pressure/intermediate pressure casing 12 via a vertical flange connection 13.

As shown in FIG. 1B, intermediate-pressure casings usually comprise an upper element 14 and a lower element 15 which are connected to each other by means of a horizontal bolted flange. Each of the two elements 14, 15 comprises two outlets 16, 17 and 18, 19 such that two outlets are arranged on the left-hand side and two outlets are provided on the right-hand side. Each outlet is connected to an exhaust pipe 20, 21, 22 and 23. More particularly, the pipe 20, 21 is connected to the outlet 16, 17 via a fabricated part 201, 211, where each fabricate part 201, 211 includes an elbow. The pipes are of specific design since the two pipes 20, 22 on the left-hand side are connected to each other and the two pipes 21, 23 on the right-hand side are also connected to each other. Thus, it is said that the intermediate-pressure casings comprise two Y-shaped exhaust pipes 24, 25. Moreover, each of the two Y-shaped exhaust pipes 24 and 25 is connected to a further pipe 26, 27.

The fabricated parts 201, 211 are connected to the upper element 14 via connecting upper flanges 28 and 29, and to pipes 20, 21 thanks to connecting horizontal flanges 28*a* and 29*a*. The connecting upper flanges 28, 29 and the connecting horizontal flanges 28*a* and 29*a* have to be dismantled for the purpose of maintenance of the HIP casing 10 and have to be properly retightened thereafter. This configuration makes the opening of said HIP casing 10 difficult. Indeed, once the dismantling of the connecting upper flanges 28 and 29 and of the connecting horizontal flanges 28*a* and 29*a* is done, it is always difficult to retighten them suitably. Besides being difficult, these maintenance operations take a long time.

In addition, the design of these intermediate-pressure casings requires the manufacture of Y-shaped pipes which are configured to be connected to other pipes. This task is complex and is associated to high costs.

In view of the foregoing, the present invention aims at providing a turbine exhaust structure permitting to overcome the above drawbacks and which is easier to maintain as well as being economical to manufacture.

SUMMARY

In one embodiment, the turbine exhaust structure includes:

A turbine exhaust structure that includes a casing divided into a first element and a second element, the second element being connected to the first element and comprising at least one outlet, at least one connecting pipe configured to be connected to a second pipe, the connecting pipe having a first end, a first section, a second end and a second section, a central aperture, the central aperture extending from a first face to a second opposite face of the casing; and where the at least one outlet of the second element is connected to the connecting pipe first end.

Such a turbine exhaust structure is configured to be connected to the combined high-pressure/intermediate-pressure casing 12 as shown in FIG. 1A.

In an embodiment, the first element is connected to the second element along a horizontal joint plane.

In an embodiment, the first element is an upper element and the second element is a lower element.

In an embodiment, the casing has a central aperture.

The central aperture may extend from a first face to a second opposite face of the casing, the section of a first face central aperture being larger than the section of a second opposite face central aperture.

In an embodiment, the second element comprises at least two outlets, preferably two outlets, each connected to a connecting pipe.

In an embodiment, the second element is connected to the connecting pipe via a welded connection.

In an embodiment, the length of the turbine exhaust structure varies from 6 to 12 meters. In an embodiment, the length of the turbine exhaust structure varies from 9 to 10 meters. In an embodiment, the width of the turbine exhaust structure may vary from 2 to 6 meters. In an embodiment, the width of the turbine exhaust structure may vary from 3 to 4 meters. In an embodiment, the height of the turbine exhaust structure may vary from 6 to 12 meters. In an embodiment, the height of the turbine exhaust structure may vary from 8 to 9 meters.

In an embodiment, the length of the turbine exhaust structure may vary from 6 to 12 meters, the width of the turbine exhaust structure may vary from 2 to 6 meters and the height of the turbine exhaust structure may vary from 6 to 12 meters. In an embodiment, the length of the turbine exhaust structure may vary from 9 to 10 meters, the width of the turbine exhaust structure may vary from 3 to 4 meters and the height of the turbine exhaust structure may vary from 8 to 9 meters.

In an embodiment, the second pipe is an elbow pipe.

In another embodiment, the turbine exhaust structure is an intermediate pressure exhaust end.

Another object of the invention relates to a high-and-intermediate-pressure casing comprising a high-pressure casing and a turbine exhaust structure according to an embodiment of the present invention.

DRAWINGS

Other features and advantages of the present invention will appear from the following description, given by way of examples and in view of the following drawings in which.

DETAILED DESCRIPTION

Figure 2:
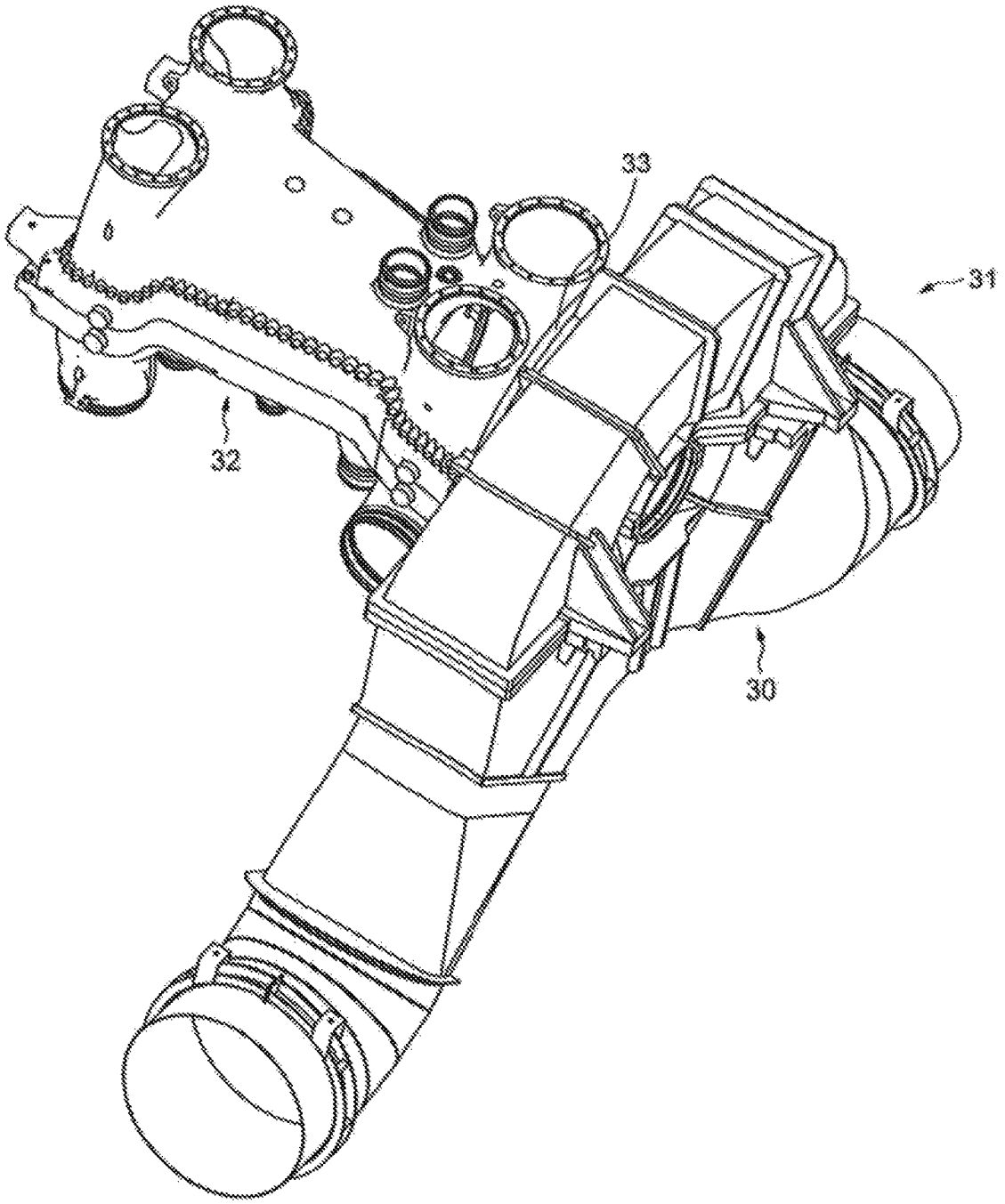
FIG. 2 is an isometric view of a high-and-intermediate-pressure casing comprising a turbine exhaust structure according to one embodiment of the invention.

Reference is first made to FIG. 2 which discloses a HIP casing 31 according to an embodiment of the invention. The high-and-intermediate-pressure casing 31 comprises a turbine exhaust structure 30, which is an intermediate-pressure exhaust end 30, and a combined high-pressure/intermediate-pressure casing 32, said casing 32 being connected to the turbine exhaust structure 30 thanks to a vertical flange connection 33.

Figure 1A:
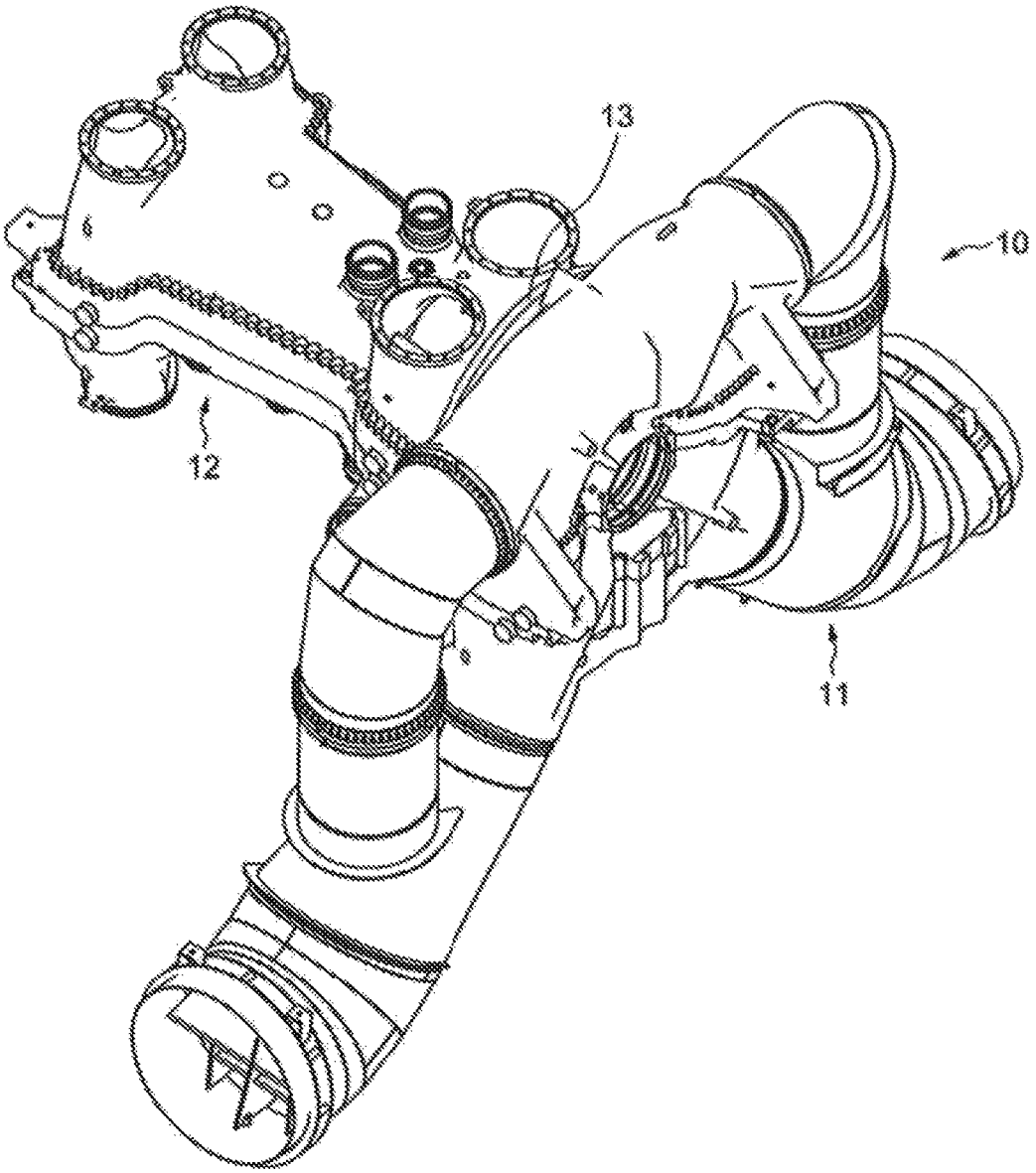
FIG. 1A is an isometric view of a HIP casing used in a known steam turbine.
Figure 1B:
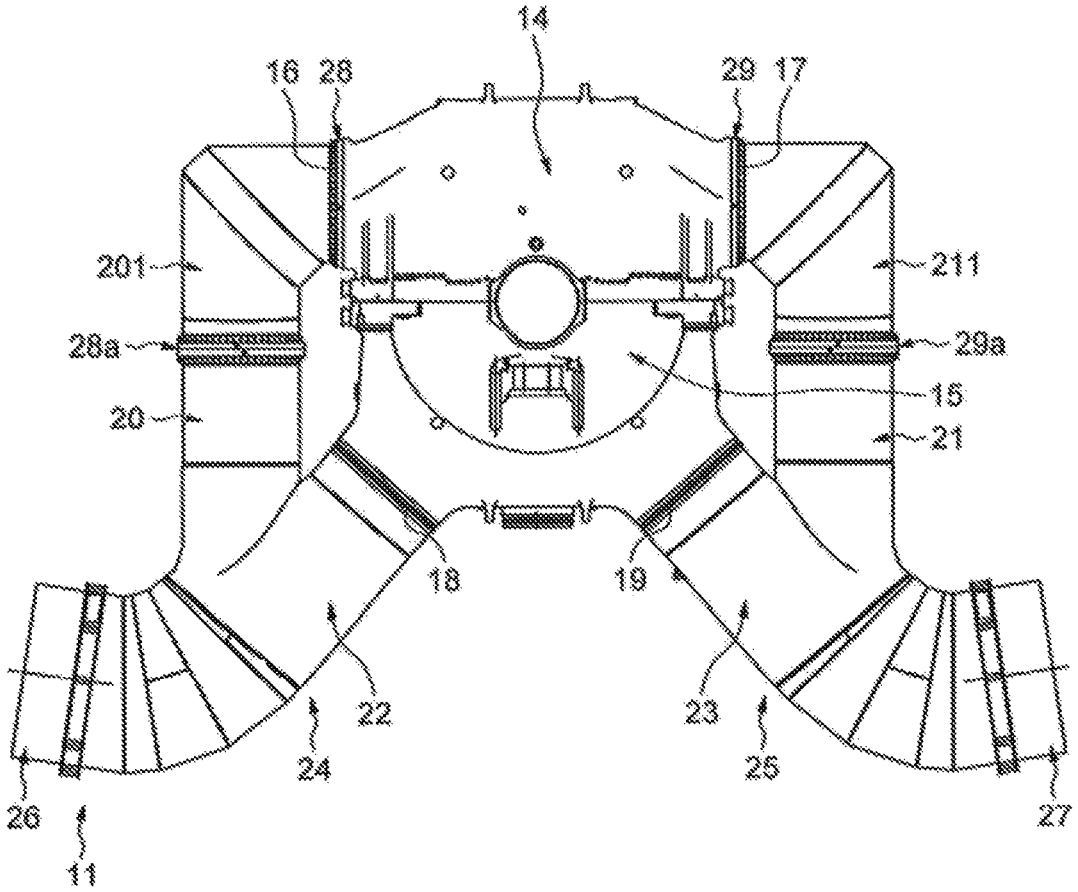
FIG. 1B is a schematic view of an intermediate-pressure exhaust end used in a known steam turbine.

It is worth noting that the combined high-pressure/intermediate-pressure casing 32 is identical to the combined high-pressure/intermediate-pressure casing 12 represented on FIG. 1A. In an embodiment, the intermediate-pressure exhaust end 30 is configured to be connected to the different modules used in a known steam turbine. In other words, the interfaces of the intermediate-pressure exhaust end 30 are configured in such a way that the design of the other components, i.e., those constituting a known steam turbine and intended to be associated to an intermediate-pressure exhaust end 30, does not need to be modified.

For example, the vertical flange connection 33 is identical to the one used in an intermediate-pressure exhaust end of the prior art like the vertical flange connection 13.

Figure 3:
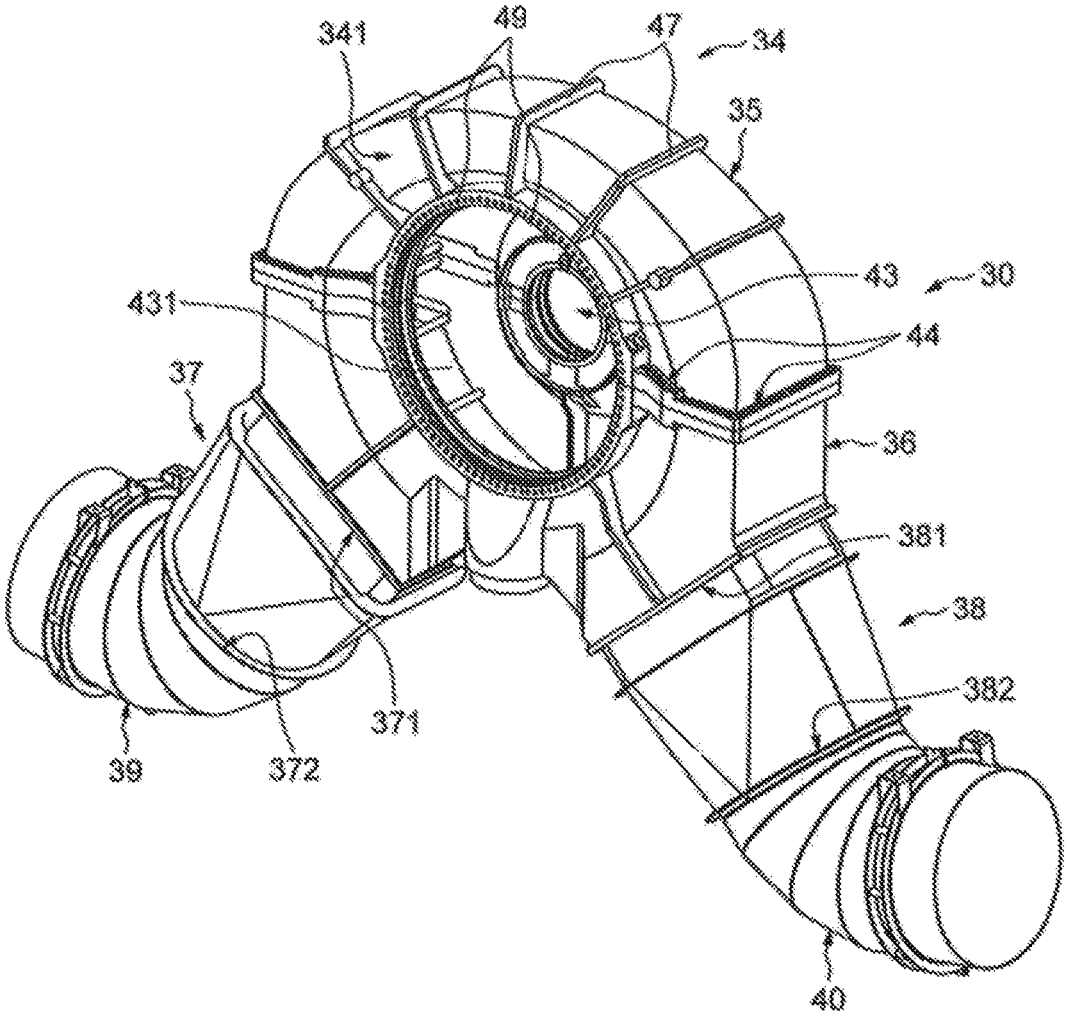
FIG. 3 is a vertical flange connection side isometric view of a turbine exhaust structure according to an embodiment of the invention.
Figure 4:
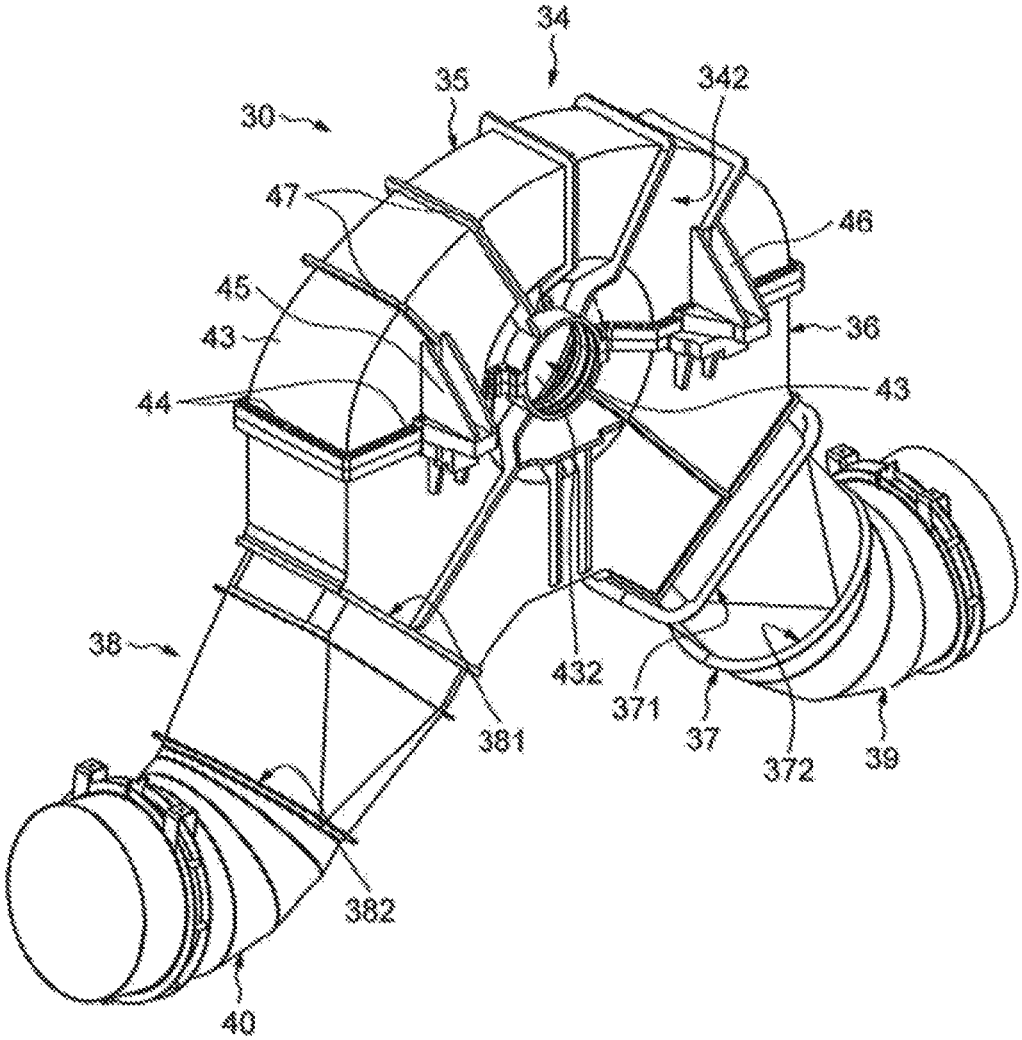
FIG. 4 is a rear pedestal side isometric view of a turbine exhaust structure according to an embodiment of the invention.

As illustrated on FIGS. 3 and 4, the intermediate-pressure exhaust end 30 comprises a casing 34 divided into a first element 35 and a second element 36, which is connected to the first element. The intermediate-pressure exhaust end 30 also comprises two connecting pipes 37, 38 which are configured to be connected to a second pipe 39 and 40. The second pipe 39, 40 is an elbow pipe.

The second element 36 comprises two outlets 41, 42 (not shown) of rectangular cross section. The connecting pipe 37, 38 is provided with a first end 371, 381, having a first section, and a second end 372, 382, having a second section. Moreover, the second element 36 is connected to the connecting pipe 37, 38 via a welded connection.

The outlet 41, 42 is connected to the first end 371, 381 and the second end 372, 382 is configured to be connected to the second pipe 39, 40.

As illustrated on FIGS. 3 and 4, the first element 35 is an upper element 35. The second element 36 is a lower element 36.

It is to be noted that the casing 34 has a central aperture 43 which extends from a first face 341, shown on FIG. 3, to a second opposite face 342 of the casing 34, shown on FIG. 4. A first face central aperture 431 has a first section and a second face central aperture 432 has a second section. The first section of the first face central aperture 431 is larger than the second section of the second face central aperture 432.

Moreover, the upper element 35 is connected to the lower element 36 along a horizontal joint plan by a plurality of studs and nuts 44 via two supports 45 and 46 on the second opposite face 342, as shown on FIG. 4.

The casing 34 comprises a plurality of outer reinforcements 47 on both the upper element 35 and the lower element 36. The outer reinforcements 47 of the lower element 36 extend radially from both the first face central aperture 431 and the second face central aperture 432. The outer reinforcements 47 of the upper element 35 extend radially from the first face central aperture 431 to the second face central aperture 432 and vice versa. The casing 34 also comprises a plurality of inner reinforcements 48 (not shown) located inside said casing 34.

In addition, the first face central aperture 431 of the casing 34 is configured to be connected with the combined high-pressure/intermediate-pressure casing 32 due to the vertical flange connection 33 and a plurality of studs and nuts 49, which are around the first face central aperture 431, and a sealing weld.

As shown on FIGS. 2, 3 and 4, no pipe is connected to the upper element 35.

Thus, such configuration makes the maintenance operations much easier as compared to the one of the intermediate-pressure casing 11 with the four outlets 16, 17, 18 and 19. Indeed, no pipe needs to be dismantled nor retightened. Specifically, the opening and closing of the HIP casing 31 is easier.

Furthermore, the turbine exhaust end according to the present invention is very cost-efficient because it allows avoiding the use of Y-shaped pipes which are very difficult to manufacture, thereby reducing quantities of materials to be used. Indeed, it is estimated that the turbine exhaust end according to the present invention allows sparing around 15 tons of materials. Moreover, the turbine exhaust end according to the present invention is also very cost-efficient because said turbine exhaust end is a fabricated structure whereas the one described in FIG. 1A is a foundry structure.

The interfaces of the intermediate-pressure exhaust end 30 are configured in such a way that the design of the other components constituting a known steam turbine, for example the diaphragms, does not need to be modified.

What is claimed is:

1. A turbine exhaust structure, comprising:

a casing divided into a first element having an arcuate shape and a second element coupled to the first element, with a central aperture formed between the first element and the second element, the central aperture extending from a first face of the casing to a second face of the casing opposing the first face, wherein the first element and the second element are configured to receive turbine exhaust, wherein a flow of the turbine exhaust in the first element is undivided from a flow of the turbine exhaust in the second element to form an unseparated turbine exhaust passage;

wherein the second element comprises at least one outlet having a rectangular cross section configured to receive the flow of turbine exhaust from the first element and the flow of turbine exhaust from the second element, wherein the at least one outlet combines the flow of turbine exhaust from the first element with the flow of turbine exhaust from the second element and directs a combined flow of turbine exhaust in a downward direction extending outward from a side of the second element;

at least one exhaust pipe having a circular cross section correspondingly coupled to the at least one outlet of the second element of the casing, wherein the at least one exhaust pipe is configured to receive only the combined flow of turbine exhaust from the second element, wherein the at least one exhaust pipe directs the downward directed combined flow of turbine exhaust received from the at least one outlet in a direction extending outward from the at least one outlet, and at least one connecting pipe configured to correspondingly connect the at least one outlet of the second element to the at least one exhaust pipe, the at least one connecting pipe having a first end with a rectangular cross section coupled to the rectangular cross section of the at least one outlet and a second end with a circular cross section coupled to the circular cross section of the at least one exhaust pipe, wherein the at least one connecting pipe directs the combined flow of turbine exhaust received from the at least one outlet in the same downward direction towards the at least one exhaust pipe, wherein the at least one exhaust pipe guides the combined flow of turbine exhaust received from the at least one connecting pipe in a direction extending laterally outward from the at least one outlet and the least one connecting pipe, wherein the turbine exhaust structure is an intermediate-pressure exhaust end.

2. The turbine exhaust structure according to claim 1, wherein the first element is connected to the second element along a horizontal joint plane.

3. The turbine exhaust structure according to claim 1, wherein the first element is an upper element, and the second element is a lower element.

4. The turbine exhaust structure according to claim 1, wherein a section of the first face of the central aperture is larger than a section of the second opposite face of the central aperture.

5. The turbine exhaust structure according to claim 1, wherein the at least one connecting pipe comprises a plurality of connecting pipes, and wherein the second element comprises at least two outlets, each outlet connected to a respective connecting pipe of the plurality of connecting pipes.

6. The turbine exhaust structure according to claim 1, wherein the second element is welded to the at least one connecting pipe.

7. The turbine exhaust structure according to claim 1, wherein a dimension of the turbine exhaust structure varies from 6 to 12 meters.

8. The turbine exhaust structure according to claim 1, wherein a dimension of the turbine exhaust structure varies from 9 to 10 meters.

9. The turbine exhaust structure according to claim 1, wherein a dimension of the turbine exhaust structure varies from 2 to 6 meters.

10. The turbine exhaust structure according to claim 1, wherein a dimension of the turbine exhaust structure varies from 3 to 4 meters.

11. The turbine exhaust structure according to claim 1, wherein no pipe is connected to the first element.

12. The turbine exhaust structure of claim 1, further comprising:

a plurality of spaced outer reinforcements on the first element and the second element, each of the spaced outer reinforcements extending radially from the central aperture about both the first face of the casing and the second face of the casing.

13. A steam turbine, comprising:

a combined high-and-intermediate pressure (HIP) casing having a high pressure casing; and an intermediate pressure turbine exhaust end structure coupled to the HIP casing, the intermediate pressure turbine exhaust structure end structure including:

a casing divided into a first element having an arcuate shape and a second element coupled to the first element, with a central aperture formed between the first element and the second element, the central aperture extending from a first face of the casing to a second face of the casing opposing the first face, wherein the first element and the second element are configured to receive turbine exhaust, wherein a flow of the turbine exhaust in the first element is undivided from a flow of the turbine exhaust in the second element to form an unseparated turbine exhaust passage;

wherein the second element comprises at least one outlet having a rectangular cross section configured to receive the flow of turbine exhaust from the first element and the flow of turbine exhaust from the second element, wherein the at least one outlet combines the flow of turbine exhaust from the first element with the flow of turbine exhaust from the second element and directs a combined flow of turbine exhaust in a downward direction extending outward from a side of the second element;

at least one exhaust pipe having a circular cross section correspondingly coupled to the at least one outlet of the second element of the casing, wherein the at least one exhaust pipe is configured to receive only the combined flow of turbine exhaust from the second element, wherein the at least one exhaust pipe directs the downward directed combined flow of turbine exhaust received from the at least one outlet in a direction extending outward from the at least one outlet, and at least one connecting pipe configured to correspondingly connect the at least one outlet of the second element to the at least one exhaust pipe, the at least one connecting pipe having a first end with a rectangular cross section coupled to the rectangular cross section of the at least one outlet and a second end with a circular cross section coupled to the circular cross section of the at least one exhaust pipe, wherein the at least one connecting pipe directs the combined flow of turbine exhaust received from the at least one outlet in the same downward direction towards the at least one exhaust pipe, wherein the at least one exhaust pipe guides the combined flow of turbine exhaust received from the at least one connecting pipe in a direction extending laterally outward from the at least one outlet and the least one connecting pipe.

14. The steam turbine according to claim 13, wherein the first face of the casing of the intermediate pressure turbine exhaust end structure is configured to connect with the HIP casing.

15. A turbine exhaust structure, comprising:

a casing divided into a first element having an arcuate shape and a second element coupled to the first element, with a central aperture formed between the first element and the second element, the central aperture extending from a first face of the casing to a second face of the casing opposing the first face, wherein the first element and the second element are configured to receive turbine exhaust, wherein a flow of the turbine exhaust in the first element is undivided from a flow of the turbine exhaust in the second element to form an unseparated turbine exhaust passage;

wherein the second element comprises a first outlet and a second outlet, each outlet having a rectangular cross section configured to receive the flow of turbine exhaust from the first element and the flow of turbine exhaust from the second element, wherein each of the first outlet and the second outlet combines the flow of turbine exhaust from the first element with the flow of turbine exhaust from the second element and directs a combined flow of turbine exhaust in a downward direction extending outward from a side of the second element, wherein the first outlet and the second outlet are located on opposing sides of the second element;

a first exhaust pipe and a second exhaust pipe correspondingly coupled with the first outlet and the second outlet of the second element of the casing, the first exhaust pipe and the second exhaust pipe each having a circular cross section, wherein the first exhaust pipe and the second exhaust pipe are each configured to receive only the combined flow of turbine exhaust from the second element, wherein each of the first and second exhaust pipes directs the downward directed combined flow of turbine exhaust received from the correspondingly coupled first outlet and second outlet in a direction extending outward from the correspondingly coupled first outlet and second outlet, and a first connecting pipe and a second connecting pipe correspondingly connecting the first and the second outlets of the second element to the first and second exhaust pipes, the first connecting pipe and the second connecting pipe each having a first end with a rectangular cross section correspondingly coupled to the rectangular cross sections of the first and the second outlets and a second end with a circular cross section correspondingly coupled to the circular cross sections of the first and the second exhaust pipes, wherein each of the first and second connecting pipes directs the combined flow of turbine exhaust received from the correspondingly coupled first outlet and second outlet in the same downward direction towards the correspondingly coupled first exhaust pipe and second exhaust pipe, wherein each of the first exhaust pipe and second exhaust pipe guides the combined flow of turbine exhaust received from the correspondingly coupled first connecting pipe and second connecting pipe in a direction extending laterally outward from the correspondingly coupled first outlet and second outlet and the correspondingly coupled first connecting pipe and second connecting pipe, wherein the turbine exhaust structure is an intermediate-pressure exhaust end.

* * * * *